US006011755A

United States Patent [19]

Mulhall et al.

[11] Patent Number: 6,011,755

[45] Date of Patent: Jan. 4, 2000

[54] ELECTRONIC TIME SWITCHES

[75] Inventors: John Mulhall, Dublin, Ireland; Kevin Doherty; David Brown, both of Greenock, United Kingdom

[73] Assignee: Schlumberger Industries, S.A., Montrouge, France

[21] Appl. No.: 08/709,367

[22] Filed: Sep. 6, 1996

[30] Foreign Application Priority Data

Sep. 8, 1995 [GB] United Kingdom ..... 9518385
Oct. 13, 1995 [GB] United Kingdom ..... 9520985

[51] Int. Cl.[7] ..... G04B 36/00

[52] U.S. Cl. ..... 368/10

[58] Field of Search ..... 368/256, 15, 17, 368/21, 22, 28, 29

[56] References Cited

U.S. PATENT DOCUMENTS

| | | | |
|---|---|---|---|
| 3,727,395 | 4/1973 | Baylor | 368/256 |
| 3,798,889 | 3/1974 | Chadwick | 368/73 |
| 4,253,169 | 2/1981 | Salah | 368/15 |
| 4,396,293 | 8/1983 | Mizoguchi | 368/15 |
| 4,512,667 | 4/1985 | Doulton et al. | 368/10 |
| 5,898,384 | 4/1999 | Alt | 340/825.36 |

*Primary Examiner*—Bernard Roskoski
*Attorney, Agent, or Firm*—Leonard W. Pojunas

[57] ABSTRACT

An electronic switch comprising at least one switching device 70,72, a reference frequency source 58, a microprocessor 50 and means for applying to the microprocessor inputs representative of at least the current time and date and the latitude at which the time switch is to be used 31–36, the microprocessor being 50 responsive to the reference frequency source 58 and the current time and date inputs to implement a real time clock and calendar 62, and being arranged to calculate from the date provided by said real time clock and calendar and from the latitude input the respective times of at least one of sunrise and sunset at said location on each of a plurality of days, and to operate the switching device 70,72 at respective switching times dependent upon the calculated times.

15 Claims, 2 Drawing Sheets

ELECTRONIC TIME SWITCHES

FIELD OF THE INVENTION

This invention relates to electronic time switches and more specifically to solar time switches.

BACKGROUND OF THE INVENTION

It is known to provide an electromechanical time switch in which the switching times can be set relative to the time of sunset or sunrise at the location of use: such time switches are usually known as solar time switches. However, because of their electromechanical construction, these time switches are complex and expensive to manufacture, and relatively inflexible to use. It is therefore an object of the present invention to provide an electronic solar time switch in which at least some of the drawbacks of electromechanical solar time switches are alleviated.

SUMMARY OF THE INVENTION

According to one embodiment of the invention, there is provided an electronic time switch comprising at least one switching device, a reference frequency source, a microprocessor and means for applying to the microprocessor inputs representative of at least the current time and date and the latitude at which the time switch is to be used, the microprocessor being responsive to the reference frequency source and the current time and date inputs to implement a real time clock and calendar, and being arranged to calculate from the date provided by said real time clock and calendar and from the latitude input the respective times of at least one of sunrise and sunset at said location on each of a plurality of days, and to operate the switching device at respective switching times dependent upon the calculated times.

In one embodiment of the invention, the input applying means is arranged to apply to the microprocessor a further input representative of the longitude at which the time switch is to be used, and the microprocessor is arranged to calculate said respective times in dependence upon said longitude as well as said latitude and time and date. The microprocessor is arranged to switch the switching device on at a switching time dependent upon or equal to the calculated time of sunset and to switch the switching device off at a switching time dependent upon or equal to the calculated time of sunrise. Advantageously, the microprocessor is programmable to switch the switching device off and back on again at respective selected times between the calculated time of sunset and the calculated time of the immediately subsequent sunrise. Conveniently, the time switch includes two switching devices which are independently operable by the microprocessor in dependence upon said calculated times in accordance with a first and a second daily switching program respectively, the microprocessor being arranged to alternate the application of said switching programs between the switching devices so as to tend to maintain their respective cumulative on periods substantially equal.

BRIEF DESCRIPTION OF THE FIGURES

The invention will now be described, by way of example only, with reference to the accompanying drawings, of which.

DETAILED DESCRIPTION OF THE INVENTION

Figure 1:
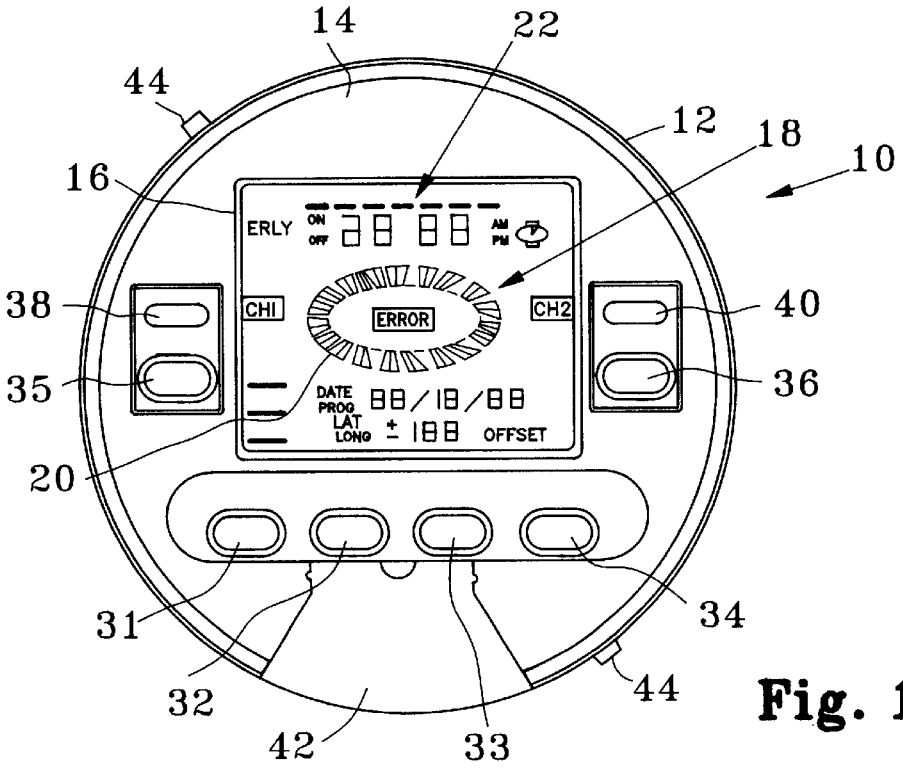
FIG. 1 is a front view of a two channel electronic solar time switch in accordance with the present invention.

The time switch of FIG. 1 is indicated at 10, and has a substantially circular body 12. The time switch 10 is of substantially the same diameter as the well-known SANGAMO round pattern time switch, which has been manufactured in various electromechanical (and latterly electronic) forms by the present applicant and its predecessors over the last sixty years: more specifically, the time switch 10 is designed to plug into the same type of standard socket used for the round pattern time switch, this socket being hard-wired to the light(s) and/or other electrical appliance(s) to be controlled by the time switch.

As will become apparent hereinafter, the time switch 10 is microprocessor-controlled, and its front face 14 includes a rectangular liquid crystal display (LCD) 16 controlled by the microprocessor. The LCD 16 is similar (but not identical) to the display which forms the subject of our United Kingdom Patent No 2 149 153, in that it has an analogue display 18, comprising an oval array of energizable indicia 20, and a digital display 22 comprising a four digit, seven segment numerical display for displaying time in a 12-hour or 24-hour clock format. The LCD 16 also has various auxiliary displays which are energized during programming or normal operation of the time switch 10, as will also become apparent hereinafter.

The front face 14 of the time switch 10 is also provided with six control buttons 31 to 36 for programming the operation of the time switch via the microprocessor, four of these buttons (31 to 34) being disposed in a line immediately beneath the LCD 16 and the other two (35, 36) being positioned one each side of the LCD 16. Each of the buttons 35, 36 has a light-emitting diode (LED), 38, 40 respectively, just above it.

Finally, the front face 14 of the time switch 10 includes a pull-out handle 42 by means of which the time switch can be unlocked and withdrawn from the aforementioned socket, while the circular body 12 is provided with two diametrically opposed, radially extending locating pips 44 which ensure the accurate alignment of the body 12 with the socket.

Figure 2:
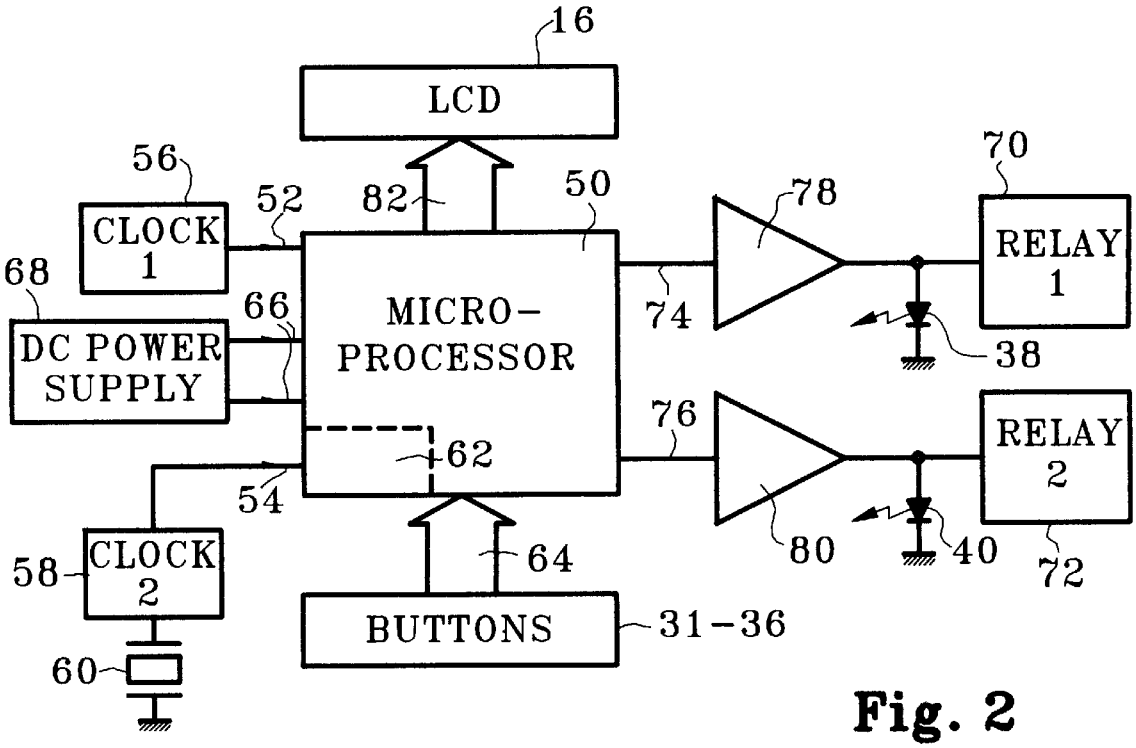
FIG. 2 is a simplified block circuit diagram of the circuitry of the time switch of FIG. 1.

With reference now to FIG. 2, as already foreshadowed, the circuitry of the time switch 10 is based upon a microprocessor, which is indicated at 50 in FIG. 2. Typically, the microprocessor 50 belongs to the H8/300L series of microprocessors, manufactured by Hitachi.

The microprocessor 50 has first and second clock inputs 52, 54. The input 52 is connected to the output of a 10 MHz clock oscillator 56, which controls the operating speed of the microprocessor, while the input 54 is connected to the output of a clock oscillator 58 based upon a highly stable 32 Khz quartz crystal (i.e. a watch crystal) 60. The clock input 54 is connected internally of the microprocessor 50 to a real time clock circuit 62, which, once set to the correct real time (including day of the month and year), maintains real time accurately in known manner: typically, the real time clock circuit is programmed to correctly account for leap years for the next 100 years.

The microprocessor 50 has a further set of inputs 64 connected to the aforementioned buttons 31 to 36 and to an input device such as a microswitch (not shown) operated by an override button provided in the aforementioned socket, as well as power supply inputs 66 connected to the output of a DC power supply circuit 68. The power supply circuit 68 is powered from the 50 Hz or 60 Hz mains power supply which the time switch is arranged to switch in order to turn the aforementioned light(s) and/or appliance(s) on and off at programmed times, and includes a battery back-up circuit which maintains the operation of the essential functions of the microprocessor 50, in particular the real time clock circuit 62 and the memory containing the data for calculating the programmed switching times, in the event of a failure of the mains power supply.

As mentioned earlier, the time switch 10 is a two-channel time switch. To this end, it has two independently controllable output relays 70, 72, one for each channel, which control the supply of mains power to respective ones of the aforementioned light(s) and/or other appliance(s) controlled by it. The relays 70, 72 are controlled in turn by the microprocessor 50, which has respective control outputs 74, 76 connected to the relays 70, 72 via respective amplifiers 78, 80. The amplifiers 78, 80 are also connected to energize the LED's 38, 40. A further set of outputs 82 of the microprocessor 50 control the LCD 16.

To set the time switch 10 up initially, it is first entered into the set-up mode using the button 31, which is called the MODE button. The buttons 35 and 36 act as increment and decrement buttons to increase or decrease the displayed values on the LCD 16 in this mode, and are used to set the real time by successively setting up hours, minutes, am/pm (unless a 24 hour time system is in use), day of the month, month and year, each of these being entered by pressing the button 34, which is called the ACCEPT button, when the desired value is displayed on the LCD. After the correct year has been entered, the microprocessor 50 calculates in known manner the day of the week on the entered date, and the LCD 16 displays that as well. Additionally, the LCD 16 then displays latitude, from −90° to +90°, the correct value for the location of use of the time switch 10 being selected using the buttons 35, 36 and entered using the ACCEPT button 34. An analogous procedure is then followed to select and enter the correct value of the longitude, between −180° and +180°, for the location of use of the time switch 10.

The user will enter local "standard time". As described below, the difference between the time zone of the user and the GMT time zone (if any) will be compensated for by an offset introduced during the setting-up.

At this point, the time switch 10 contains all its required set-up data, and the MODE button 31 is pressed to enter all this data, i.e. the selected real time and location of use data, into the memory of the microprocessor 50 and to simultaneously set the time switch to its program mode.

Once fully set up, the microprocessor 50 calculates for each successive day, typically just after the day begins (i.e. just after midnight of the previous day), the time of sunrise and sunset on that day at the location of use of the time switch 10, using formulae of the form $$T\ (\text{sunrise})=(180-E-t+l)/15$$

$$T\ (\text{sunset})=(180-E+t+l)/15$$

where E represents the position of the earth relative to the sun at the current date indicated by the real time clock circuit 62, calculated from Jan. 1st, 1900 as a base date, t represents the "hour angle" of the location of use of the time switch, derived from the latitude and longitude values entered, and l represents a correction for the time difference between the time at the longitude of use and GMT, i.e. the time difference in the sunrise or sunset times at the Greenwich meridian and at the longitude in question due solely to the difference in longitude. The precise equations for deriving each of E and t are described in detail in NAO Technical Note No 46 of January 1978, entitled "Formulae for computing astronomical data with hand-held calculators", issued by the Science and Engineering Research Council, Royal Greenwich Observatory. These formulae calculate sunrise and sunset times at any location on the earth with reference to GMT, hence the need for the correction based on the longitude of the location of use.

In entering the real time at the location of use, any daylight saving offset should be ignored, and in countries where the "standard time" includes such an offset or an offset due to the geographical position of a national boundary (i.e. a time zone change), the offset can be separately entered during the setting-up process so that the calculation takes account of it.

In the case of the calculation for a time zone different from that of the GMT time zone, the offset will be subtracted from the entered time zone to enable the calculation to be carried out in GMT and then added to the end result to convert the sunrise and sunset times to local time. This time zone offset correction is of course carried out in addition to the longitudinal correction using the offset correction factor l described above.

In its factory-programmed state, the microprocessor 50 is programmed to switch the relays 70, 72 off at the calculated sunrise time each day, and on at the calculated sunset time each day. So if the user is happy with this program, he or she need do no further programming, and can simply press the MODE button 31 to set the time switch 10 to its run (or normal) mode, in which it will operate the relays 70, 72 at sunrise and sunset.

When the time switch 10 is in its normal mode, the buttons 35, 36 act as channel select buttons, and operation of either of them serves to switch the time switch back and forth between the two channels. In the set-up mode, the data entered is clearly relevant to, and used in the operation of, both channels. But when the time switch 10 is set to the program mode, that mode is applicable only to whichever one of the two channels was selected prior to entry into the set-up mode, and the user can then change the factory-set program for the selected channel.

In particular, the user can select an "Early Off" time, in which the microprocessor 50, having switched the relay 70 or 72 on at sunset, will switch it off again at a programmed time before sunrise. Thus, when the program mode is entered, an "Early Off" display among the aforementioned auxiliary displays of the LCD 16 is energized, and the user can select a desired off time using the buttons 35, 36 and enter it using the button 34. At this point an "Early On" display among the auxiliary displays of the LCD 16 is energized, and the user can if desired select a time earlier than sunrise for the microprocessor 50, having switched the relay 70 or 72 off at a selected "Early Off" time, to switch it back on again.

The buttons 32 and 33, called the OMIT and CANCEL buttons respectively, are used during programming to omit certain days (e.g. weekends) from the programmed switching times, and to cancel incorrect entries, respectively.

While the time switch 10 is in its program mode, the analogue display 18 in the LCD 16, which analogue display represents a 24 hour clock face, displays the selected time periods for which the relay 70 or 72 of the currently selected channel will be switched on by energizing groups of adjacent indicia corresponding to the time periods (so these time periods can be seen to change as programming progresses). Once the time switch 10 is set to its normal mode via the MODE button 31, the analogue display 18 will continue to display the time periods for which the relay 70 or 72 of the currently selected channel is programmed to be switched on, while the digital display 22 will display the current real time in 12- or 24-hour format. And when either of the relays 70, 72 is actually switched on, the respective ones of the LED's 38, 40 will be energized to provide a visual indication of that fact.

Operation of the aforementioned override button while the time switch 10 is in its normal mode switches the relay 70 or 72 of the currently selected channel off if it is currently on, with normal operation resuming at the next programmed on time. However, if the relevant one of the relays 70, 72 is currently off, operation of the override button switches it on, either for a predetermined boost period, e.g. two hours, or until its next programmed off time (whichever period is shorter).

Many modifications can be made to the embodiment of the invention described with relation to FIGS. 1 and 2. For example, where significant numbers of the time switches 10 are being sold to a customer such as a municipal authority, for use in a known common location such as a single city, the latitude and longitude of the city can be entered into each time switch prior to delivery, to save the customer the trouble of doing it. Also, as an alternative to entering actual longitude in degrees, an equivalent time offset can be entered, enabling slightly simplified versions of the aforementioned formulae for calculating the time of sunset and sunrise to be used. This equivalent time offset will be in addition to any offset introduced to compensate for any time zone differences.

Additionally, where the time switches 10 are being used to control lighting, e.g. street lighting or lighting in communal areas in or around buildings, such that all the lights come on at sunset, and half the lights go off at, say, midnight under the control of one channel of the time switch while the other half remain on until sunrise under the control of the other channel, the respective programs of the two channels can be arranged to automatically exchange with each other each day, typically at midday, in order to ensure that all the lights get substantially the same amount of use (since the half of the lights that stay on all night on one night will be switched off at midnight on the following night, and vice versa). This exchange of programs between channels is simply achieved, by arranging for the microprocessor 50 to alternate the application of the respective control signals resulting from the programs between its control outputs 74, 76.

Further, although the time switch 10 described is a two channel device, a single channel device, with only a single one of the relays 70 or 72, is possible. Also, although the analogue display 18 is very desirable, it is not essential. Moreover, the principal switching on and switching off times need not be sunset and sunrise respectively as described, but can for example be programmed to be a selected time period, e.g. 15 minutes or 30 minutes, after sunset and sunrise.

Figure 3:
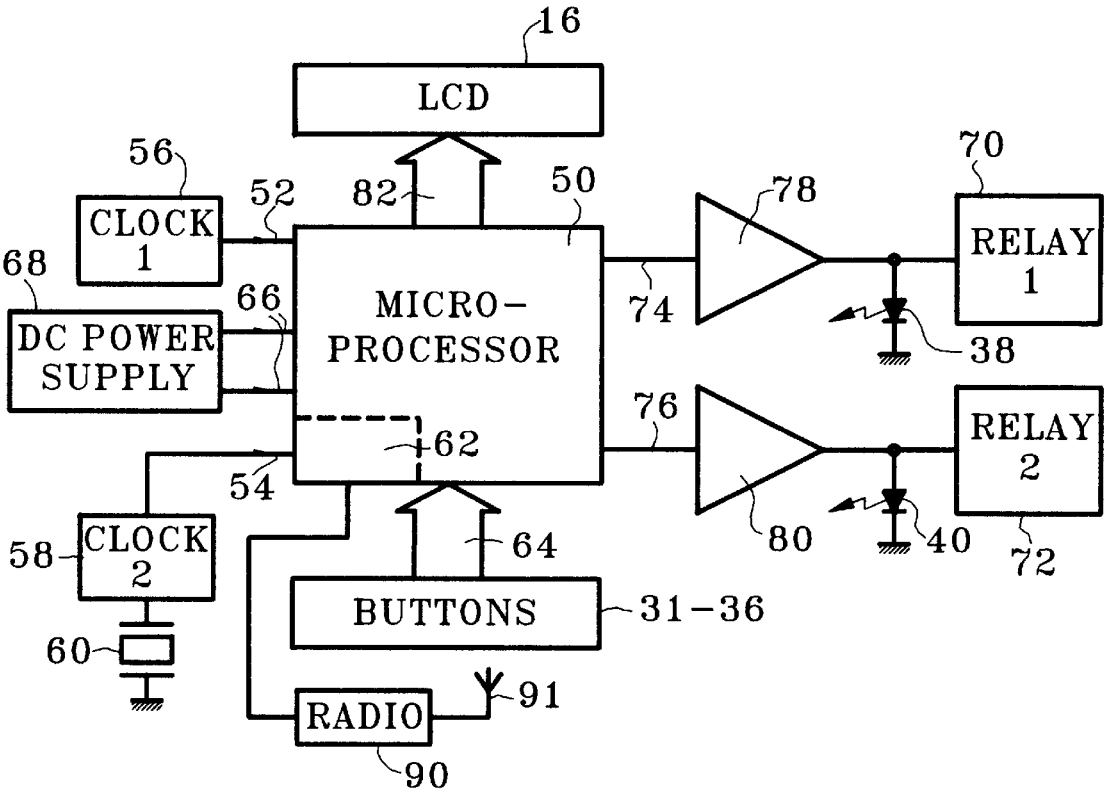
FIG. 3 is a further embodiment of the invention including a radio receiver circuit adapted to receive real-time time and date information.

Additionally, in the embodiment of FIG. 3 the means for applying to the microprocessor inputs representative of the current time and date comprises a radio receiver 90 and antenna 91 adapted to receive radio signals incorporating real-time time and date information. This information is used by the clock circuit 62 to maintain its internal clock and calendar. Such radio transmissions are well known in certain countries, e.g. the UK, where they are used to control and synchronize the operation of devices such as tariff-based electricity meters or heating systems distributed throughout the territory. The construction of a radio receiver adapted to receive and process such signals to derive time and date information is well known and will not be described here in detail. In this embodiment, the key operations previously required to enter the time and date information using the buttons 31–36 are rendered unnecessary.

We claim:

1. An electronic switch for controlling a street lighting system having at least one street light, comprising:

at least one switching device, a reference frequency source, a microprocessor, and a means for applying to the microprocessor inputs representative of at least the current time and date and the latitude at which the switch is to be used, the microprocessor being responsive to the reference frequency source and the current time and date inputs to implement a real time clock and calendar, and being arranged to calculate from the date provided by said real time clock and calendar and from the latitude input the respective times of at least one of sunrise and sunset at said location on each of a plurality of days, and to operate the switching device to turn on and off at least one street light of the street lighting system at respective switching times dependent upon the calculating times, wherein the means for applying is arranged to apply to the microprocessor a further input representative of an equivalent time offset, and the microprocessor is arranged to calculate said respective times in dependence on the equivalent time offset as well as said latitude and the time and date.

2. A time switch as claimed in claim 1, wherein the input applying means is arranged to apply to the microprocessor a further input representative of the longitude at which the time switch is to be used, and the microprocessor is arranged to calculate said respective times in dependence upon said longitude as well as said latitude and the time and date.

3. A time switch as claimed in claim 1, wherein the input applying means is arranged to introduce an offset which is used by the microprocessor to compensate for time zone changes between the location of the time switch and GMT.

4. A time switch as claimed in claim 1, wherein the microprocessor is programmable to switch the switching device off and back on again at respective selected times between the calculated time of sunset and the calculated time of the immediately subsequent sunrise.

5. A time switch as claimed in claim 1, wherein the time switch includes two switching devices which are independently operable by the microprocessor in dependence upon said calculated times in accordance with a first and second daily switching program respectively, the microprocessor being arranged to alternate the application of said switching programs between the switching devices so as to tend to maintain their respective cumulative on periods substantially equal.

6. A time switch as claimed in claim 1, wherein the means for applying to the microprocessor inputs representative of the current time and date comprises a radio receiver and antenna adapted to receive radio signals incorporating real-time time and date information.

7. An apparatus comprising:

electronic switching device for controlling a street lighting system having at least one street light, a reference frequency source, means for providing inputs representative of at least the current time and date and the latitude at which the switch is to be used, and an equivalent time offset, a microprocessor being responsive to the reference frequency source and the current time and date inputs to implement a real time clock and calendar, and being arranged to calculate from the date provided by said real time clock and calendar and from the latitude input the respective times of at least one of sunrise and sunset at said location on each of a plurality of days, and to operate the electronic switching device to turn on and off the at least one street light of the street lighting system at respective switching times dependent upon the calculated times and equivalent time offset.

8. A time switch as claimed in claim 7, wherein the input providing means is arranged to provide to the microprocessor a further input representative of the longitude at which the time switch is to be used, and the microprocessor is arranged to calculate said respective times in dependence upon said longitude as well as said latitude and the time and date.

9. A time switch as claimed in claim 7, wherein the input providing means is arranged to introduce an offset which is used by the microprocessor to compensate for time zone changes between the location of the time switch and GMT.

10. A time switch as claimed in claim 7, wherein the microprocessor is arranged to switch the switching device on at a switching time dependent upon or equal to the calculated time of sunset and to switch the switching device off at a switching time dependent upon or equal to the calculated time of sunrise.

11. A time switch as claimed in claim 7, wherein the microprocessor is programmable to switch the switching device off and back on again at respective selected times between the calculated time of sunset and the calculated time of the immediately subsequent sunrise.

12. A time switch as claimed in claim 7, wherein the means for providing the inputs representative of the current time and date comprises a radio receiver and antenna adapted to receive radio signals incorporating real-time time and date information.

13. An apparatus comprising:

electronic switch comprising two switching devices connected to control a street lighting system having at least one street light, a reference frequency source, means for providing inputs representative of at least the current time and date and the latitude at which the time switch is to be used, a microprocessor being responsive to the reference frequency source and the current time and date inputs to implement a real time clock and calendar, arranged to calculate from the date provided by said real time clock and calendar and from the latitude input the respective times of at least one of sunrise and sunset at said location on each of a plurality of days, and to operate the electronic switching device at respective switching times dependent upon the calculated times, and arranged to independently operate the two switching devices to turn on and off the at least one street light of the street lighting system in dependence upon said calculated times in accordance with a first and second daily switching program respectively, the microprocessor being arranged to alternate the application of said switching programs between the switching devices so as to tend to maintain their respective cumulative on periods substantially equal, and arranged to switch the switching device on at a switching time dependent upon or equal to the calculated time of one of sunset or sunrise and to switch the switching device off at a switching time dependent upon or equal to the calculated time of the other of sunrise or sunset.

14. A time switch as claimed in claim 13, wherein the input providing means is arranged to provide to the microprocessor a further input representative of an equivalent time offset, and the microprocessor is arranged to calculate said respective times in dependence on the equivalent time offset as well as said latitude and the time and date.

15. An electronic switch for controlling a street lighting system having at least one street light comprising:

at least one switching device, a reference frequency source, a microprocessor, and a means for applying to the microprocessor inputs representative of at least the current time and date and the latitude at which the switch is to be used, the microprocessor being responsive to the reference frequency source and the current time and date inputs to implement a real time clock and calendar, and being arranged to calculate from the date provided by said real time clock and calendar and from the latitude input the respective times of at least one of sunrise and sunset at said location on each of a plurality of days, and to operate the switching device to turn on and off at least one of the street lighting system at respective switching times dependent upon the calculating times, wherein the microprocessor is arranged to switch the switching device on at a switching time dependent upon or equal to the calculated time of one of sunrise or sunset and to switch the switching device off at a switching time dependent upon or equal to the calculated time of the other of sunrise or sunset.

* * * * *

UNITED STATES PATENT AND TRADEMARK OFFICE

CERTIFICATE OF CORRECTION

PATENT NO. : 6,011,755 
DATED : January 4, 2000
INVENTOR(S) : John Mulhall, Kevin Doherty and David Brown It is certified that error appears in the above-identified patent and that said Letters Patent is hereby corrected as shown below:

Title page,
Item [73], Assignee, replace "Schlumberger Industries, S.A., Montrouge, France" with -- Schlumberger Industries Limited, London, England --.

Signed and Sealed this

Twenty-sixth Day of August, 2003

JAMES E. ROGAN
*Director of the United States Patent and Trademark Office*